US010876805B1

(12) United States Patent
Oglesby

(10) Patent No.: US 10,876,805 B1
(45) Date of Patent: Dec. 29, 2020

(54) GAS BLOCK ASSEMBLY

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 16/274,436

(22) Filed: Feb. 13, 2019

Related U.S. Application Data

(60) Provisional application No. 62/630,435, filed on Feb. 14, 2018.

(51) Int. Cl.
*F41A 5/26* (2006.01)
*F41A 21/28* (2006.01)

(52) U.S. Cl.
CPC ..... *F41A 5/26* (2013.01); *F41A 21/28* (2013.01)

(58) Field of Classification Search
CPC ..... F41A 5/18; F41A 5/20; F41A 5/22; F41A 5/24; F41A 5/26; F41A 5/28; F41A 21/28
USPC ..... 89/191.01, 191.02, 192, 193
See application file for complete search history.

(56) References Cited

U.S. PATENT DOCUMENTS 2,137,612 A * 11/1938 Reuben ..... F41A 21/08 89/126
2,509,734 A * 5/1950 Reuben ..... F41F 1/08 89/126
5,103,714 A 4/1992 LaFrance
2012/0152104 A1* 6/2012 Audibert ..... F41A 5/18 89/191.01
2012/0167756 A1* 7/2012 Larue ..... F41A 5/28 89/193
2014/0150638 A1* 6/2014 Ricks ..... F41A 5/28 89/193
2014/0174285 A1* 6/2014 Baker ..... F41A 5/22 89/129.01
2016/0161200 A1* 6/2016 Windauer ..... F41A 5/28 89/193
2018/0142974 A1* 5/2018 Hanson ..... F41A 5/28
2018/0172376 A1* 6/2018 Alexander ..... F41A 9/72

* cited by examiner

*Primary Examiner* — Bret Hayes
(74) *Attorney, Agent, or Firm* — Shaddock Law Group, PC

(57) ABSTRACT

A gas block assembly, including at least some of a gas block having a barrel borehole; an initial gas tube at least partially received within at least a portion of the gas block; and a primary gas tube at least partially received within at least a portion of the gas block, wherein an interior of the barrel borehole is in fluid communication with the initial gas tube, and wherein the initial gas tube is in fluid communication with the primary gas tube.

20 Claims, 8 Drawing Sheets

GAS BLOCK ASSEMBLY

CROSS-REFERENCE TO RELATED APPLICATIONS

This patent application claims the benefit of U.S. Patent Application Ser. No. 62/630,435, filed Feb. 14, 2018, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a gas block assembly for a firearm.

2. Description of Related Art

A number of firearms operate based on a gas blowback system. One such firearm is the M-16, M-4, and AR-15 family of firearms.

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier and the bolt and drives the bolt carrier rearward.

The buffer, which is pushing on the rear of the bolt carrier group, is forced rearward by the bolt carrier group compressing the recoil spring. During this rearward movement, a cam track in the upper portion of the bolt carrier acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the rear of the buffer tube), the compressed recoil spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, the originally designed gas system was designed with a 20" barrel and a rifle length gas system. The original gas system was approximately 15" long and captured gas much further away from the chamber, where the highest gas pressures are generated. The resultant energy impulse captured to cycle the firearm was much softer than shorter barreled rifles that capture gas from shorter barrels, using mid-length, carbine, or pistol length gas systems.

The disadvantages and shortcomings of the prior art are overcome by the features and elements of the gas block assembly of the present disclosure. The advantages of the present disclosure are optionally attained by providing, in an exemplary, nonlimiting embodiment, a gas block assembly that utilizes a modified gas block with a substantially linear, low profile assembly. In various exemplary embodiments, elements of the gas block assembly are attached or coupled together using conventional roll pins. This allows the elements of the gas block assembly to be less heat sensitive than systems that may be attached or coupled together using soldering or brazing.

By utilizing a primary gas tube and an initial gas tube that are in fluid communication with one another, the gas block assembly of the present disclosure allows for the gas to travel along, for example, a combined 15" tube assembly, which reduces gas power on short barrel rifles and firearms running shorter than rifle length gas systems. The resultant gas energy creates a softer cycling action that reduces stress to the working parts and transfers less recoil energy into the shooter's shoulder.

In various exemplary, nonlimiting embodiments, the gas block assembly of the present disclosure includes at least some of a gas block body portion extending from a distal end to a proximal end; a gas block extension portion extending from the gas block body portion; a barrel borehole extending through at least a portion of the body portion, along a longitudinal axis of the body portion, wherein the barrel borehole is adapted to receive at least a portion of a barrel therethrough; a gas block initial borehole extending through at least a portion of the gas block extension portion; a gas block barrel gas port formed between the barrel borehole and the gas block initial borehole, such that the gas block barrel gas port allows fluid communication between the barrel borehole and the gas block initial borehole; an initial gas tube, wherein the initial gas tube is at least partially received within at least a portion of the gas block initial borehole, wherein a first initial gas tube port is formed through the initial gas tube, wherein a second initial gas tube port is formed through the initial gas tube, wherein the first initial gas tube port is aligned with the barrel gas port so as to allow fluid communication between the barrel borehole and an interior of the initial gas tube; a gas block primary borehole extending through at least a portion of the gas block extension portion; a gas tube gas port formed between the gas block initial borehole and the gas block primary borehole, such that the gas tube gas port allows fluid communication between the gas block initial borehole and the gas block primary borehole, wherein the second initial gas tube port is aligned with the gas tube gas port so as to allow fluid communication between the interior of the initial gas tube and the gas block primary borehole; and a primary gas tube, wherein the primary gas tube is at least partially received within at least a portion of the gas block primary borehole, wherein a primary gas tube port is formed through the primary gas tube; wherein the primary gas tube port is aligned with the gas tube gas port so as to allow fluid communication between the interior of the initial gas tube and an interior of the primary gas tube.

In various exemplary, nonlimiting embodiments, the gas block extension portion extends beyond the proximal end of the gas block body portion.

In various exemplary, nonlimiting embodiments, the gas block extension portion does not extend beyond the proximal end of the gas block body portion.

In various exemplary, nonlimiting embodiments, the initial gas tube port is formed proximate a distal end of the initial gas tube.

In various exemplary, nonlimiting embodiments, a proximal end of the primary gas tube is adapted to be received within a gas tube receiving aperture of an upper receiver.

In various exemplary, nonlimiting embodiments, a gas tube plug is disposed within at least a portion of the interior of the initial gas tube, proximate a distal end of the initial gas tube.

In various exemplary, nonlimiting embodiments, a gas tube plug is disposed within at least a portion of the interior of the initial gas tube, proximate a proximal end of the initial gas tube.

In various exemplary, nonlimiting embodiments, a gas tube plug is disposed within at least a portion of the interior of the primary gas tube, proximate a distal end of the primary gas tube.

In various exemplary, nonlimiting embodiments, the initial gas tube is attached or coupled within at least a portion of the gas block initial borehole, via interaction of a roll pin and a distal initial gas tube roll pin aperture.

In various exemplary, nonlimiting embodiments, the primary gas tube is attached or coupled within at least a portion of the gas block primary borehole, via interaction of a roll pin and a distal primary gas tube roll pin aperture.

In various exemplary, nonlimiting embodiments, the primary gas tube is attached or coupled within at least a portion of the gas block primary borehole, via interaction of a roll pin and a proximal primary gas tube roll pin aperture.

In various exemplary, nonlimiting embodiments, the gas block assembly of the present disclosure includes at least some of a gas block assembly including at least some of a gas block body portion having a barrel borehole extending through at least a portion of the body portion; a gas block extension portion extending from the gas block body portion; a gas block initial borehole extending through at least a portion of the gas block extension portion, wherein the gas block initial borehole is in fluid communication with the barrel borehole; and a gas block primary borehole extending through at least a portion of the gas block extension portion, wherein the gas block primary borehole is in fluid communication with the gas block initial borehole.

In various exemplary, nonlimiting embodiments, the initial gas tube is at least partially received within at least a portion of the gas block initial borehole, and wherein a primary gas tube is at least partially received within at least a portion of the gas block primary borehole.

In various exemplary, nonlimiting embodiments, at least a portion of the initial gas tube is alignable within at least a portion of the gas block initial borehole such that the initial gas tube is in fluid communication with the barrel borehole and the gas block primary borehole and wherein at least a portion of the primary gas tube is alignable within at least a portion of the gas block primary borehole such that the primary gas tube is in fluid communication with the gas block initial borehole.

In various exemplary, nonlimiting embodiments, a first initial gas tube port is formed through the initial gas tube and a second initial gas tube port is formed through the initial gas tube.

In various exemplary, nonlimiting embodiments, a primary gas tube port is formed through the primary gas tube.

In various exemplary, nonlimiting embodiments, a barrel gas port is formed within a portion of the gas block body so as to allow fluid communication between the barrel borehole and the gas block initial borehole.

In various exemplary, nonlimiting embodiments, a gas tube gas port is formed within a portion of the gas block body so as to allow fluid communication between the gas block initial borehole and the gas block primary borehole.

In various exemplary, nonlimiting embodiments, the gas block extension portion extends beyond a proximal end of the gas block body portion.

In various exemplary, nonlimiting embodiments, the gas block assembly of the present disclosure includes at least some of a gas block having a barrel borehole; an initial gas tube at least partially received within at least a portion of the gas block; a primary gas tube at least partially received within at least a portion of the gas block, wherein an interior of the barrel borehole is in fluid communication with the initial gas tube, and wherein the initial gas tube is in fluid communication with the primary gas tube.

Accordingly, the presently disclosed systems, methods, and/or apparatuses provide a gas block assembly that allows a desirable amount of propellant gas to be returned to the firearm for cycling the bolt during a firing cycle.

The presently disclosed systems, methods, and/or apparatuses optionally and separately provide a gas block assembly that utilizes a single gas block chassis that allows different length gas tube to be fitted to the gas block, depending on the barrel length the gas block assembly is mounted to.

The presently disclosed systems, methods, and/or apparatuses optionally and separately provide a gas block assembly that may optionally provide increased bolt lock time.

The presently disclosed systems, methods, and/or apparatuses optionally and separately provide a gas block assembly that reduces felt recoil.

The presently disclosed systems, methods, and/or apparatuses optionally and separately provide a gas block assembly that creates a softer cycling action.

The presently disclosed systems, methods, and/or apparatuses optionally and separately provide a gas block assembly that reduces stress to the working parts of the firearm.

The presently disclosed systems, methods, and/or apparatuses optionally and separately provide a gas block assembly that allows the gas system to be "tuned".

The presently disclosed systems, methods, and/or apparatuses optionally and separately provide a gas block assembly that can fit within at least a portion of the vertical space of a free float handguard.

The presently disclosed systems, methods, and/or apparatuses optionally and separately provide a gas block assembly that reduces back pressure from suppressors, when a suppressor is installed on the firearm.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

For simplicity and clarification, the design factors and operating principles of the gas block assembly according to the presently disclosed systems, methods, and/or apparatuses are explained with reference to various exemplary embodiments of a gas block assembly according to the presently disclosed systems, methods, and/or apparatuses. The basic explanation of the design factors and operating principles of the gas block assembly is applicable for the understanding, design, and operation of the gas block assembly of the presently disclosed systems, methods, and/or apparatuses. It should be appreciated that the gas block assembly can be adapted to many applications where gas pressure or blowback is experienced within a firearm.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "firearm", "gas block", and "gas tube" are used for basic explanation and understanding of the operation of the systems, methods, and apparatuses of this invention. Therefore, the terms "firearm", "gas block", and "gas tube" are not to be construed as limiting the systems, methods, and apparatuses of this invention. Thus, for example, the term "firearm" is to be understood to broadly include any firearm having a blowback operated system.

Figure 1:
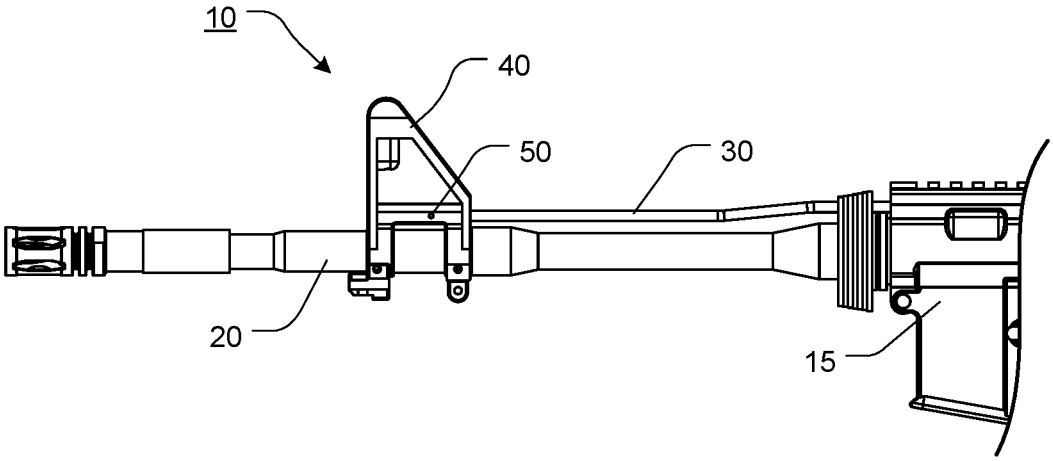
FIG. 1 PRIOR ART
FIG. 1 illustrates a side view of a portion of a known AR-15 style barrel assembly, showing a known front sight (or gas block)
Figure 2:
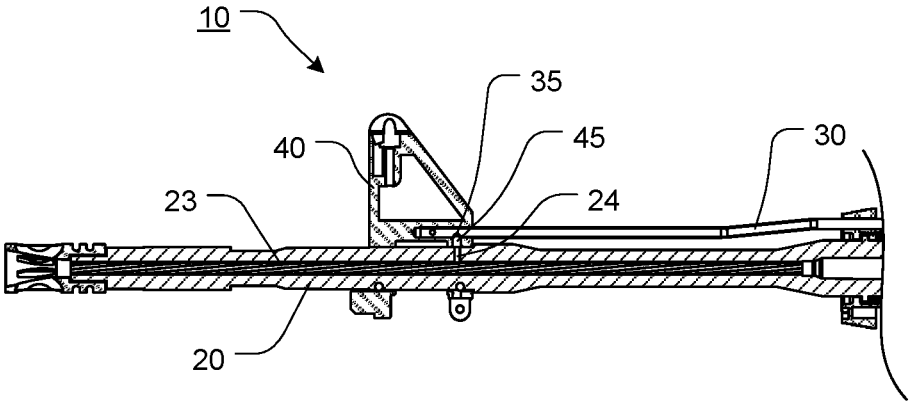
FIG. 2 PRIOR ART
FIG. 2 illustrates a side cutaway view of a portion of a known AR-15 style barrel assembly, showing a known front sight (or gas block)
Figure 3:
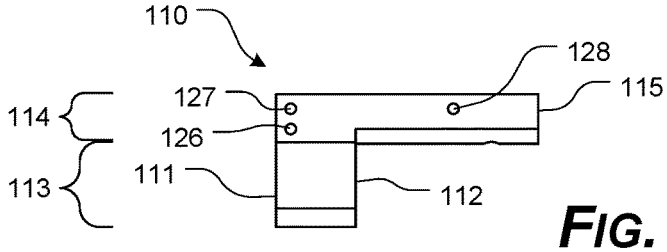
FIG. 3 illustrates a side view of an exemplary embodiment of a gas block, according to the presently disclosed systems, methods, and/or apparatuses.
Figure 4:
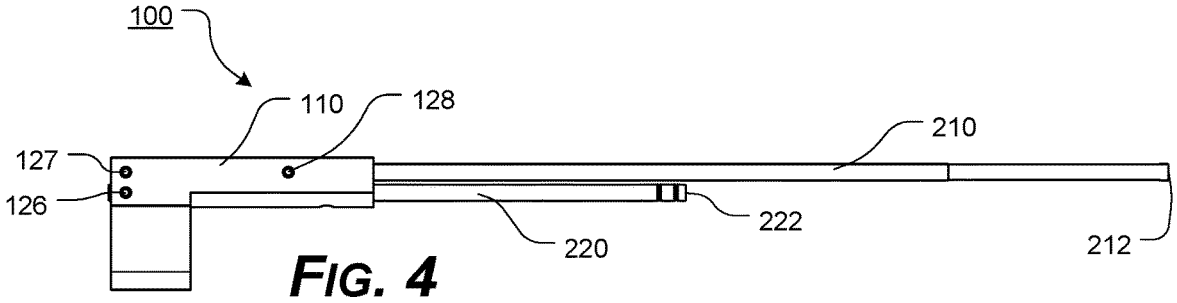
FIG. 4 illustrates a side view of an exemplary embodiment of a gas block assembly, according to the presently disclosed systems, methods, and/or apparatuses.
Figure 5:
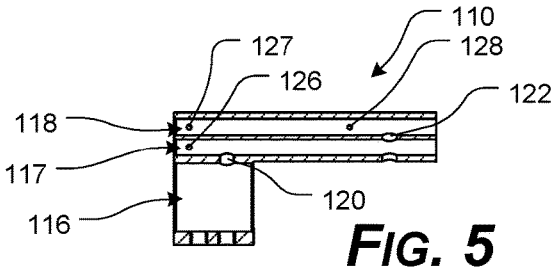
FIG. 5 illustrates a side, cross-sectional view of an exemplary embodiment of a gas block, according to the presently disclosed systems, methods, and/or apparatuses.
Figure 6:
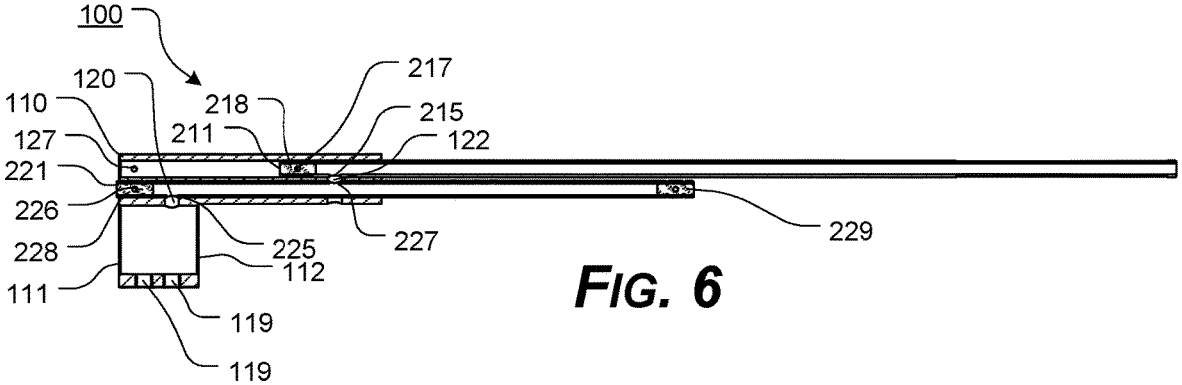
FIG. 6 illustrates a side, cross-sectional view of an exemplary embodiment of a gas block assembly, according to the presently disclosed systems, methods, and/or apparatuses.
Figure 7:
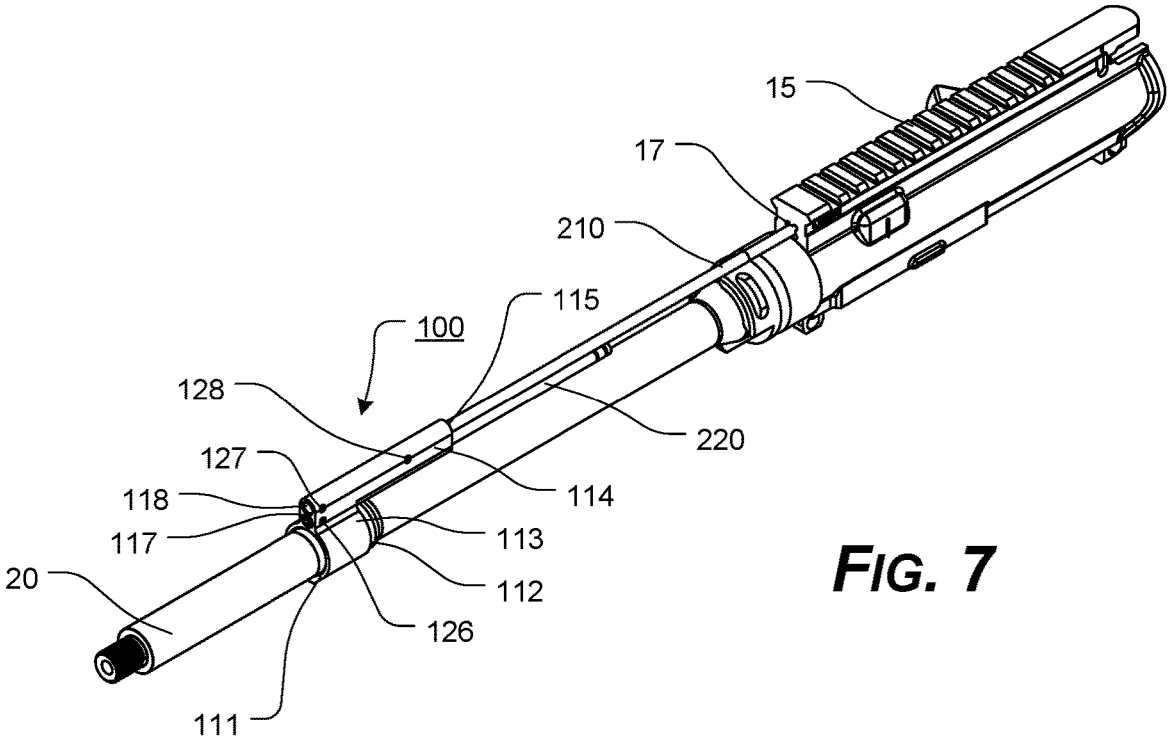
FIG. 7 illustrates a perspective view of an exemplary embodiment of a gas block assembly attached or coupled to a firearm barrel and upper receiver, according to the presently disclosed systems, methods, and/or apparatuses.
Figure 8:
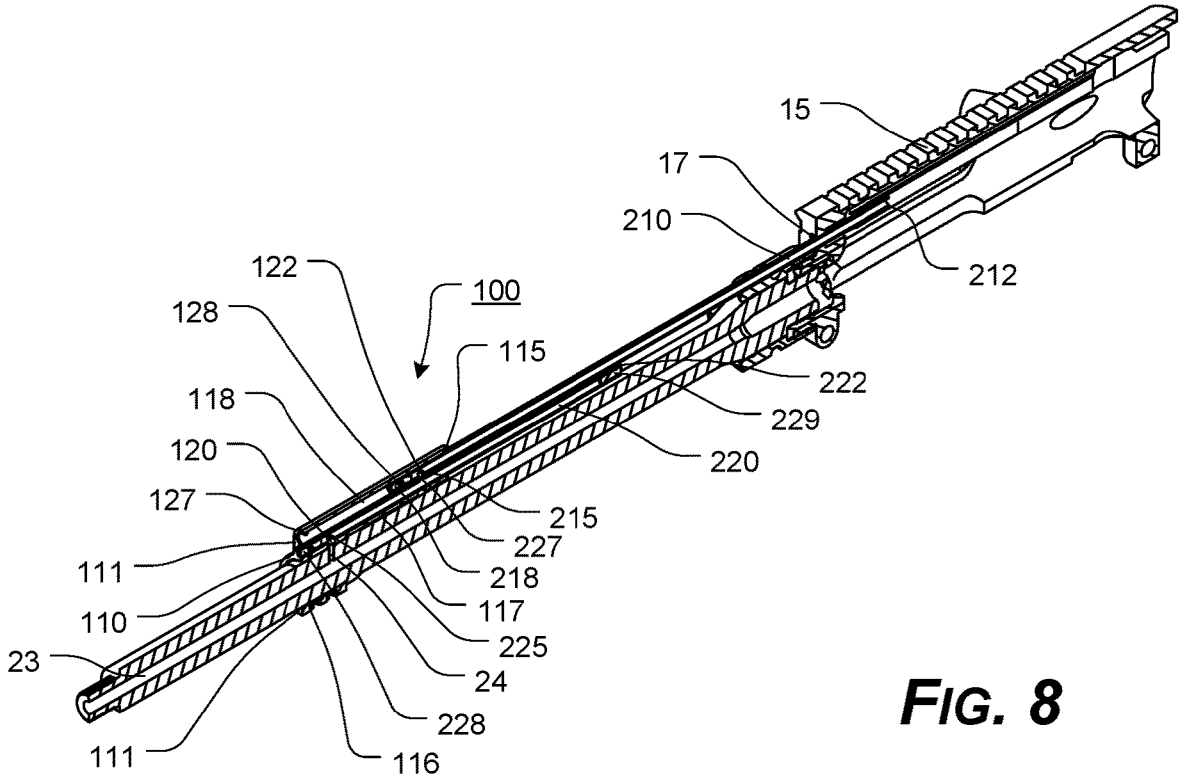
FIG. 8 illustrates a perspective, cross-sectional view of an exemplary embodiment of a gas block assembly attached or coupled to a firearm barrel and upper receiver, according to the presently disclosed systems, methods, and/or apparatuses.
Figure 9:
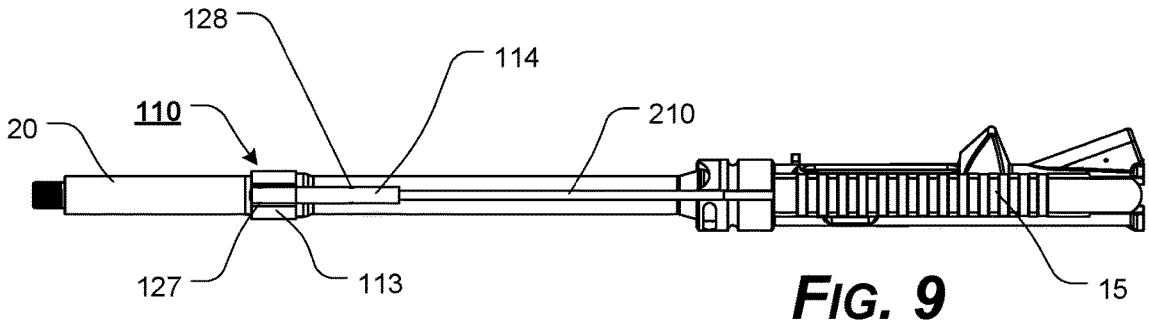
FIG. 9 illustrates a top view of an exemplary embodiment of a gas block assembly attached or coupled to a firearm barrel and upper receiver, according to the presently disclosed systems, methods, and/or apparatuses.
Figure 10:
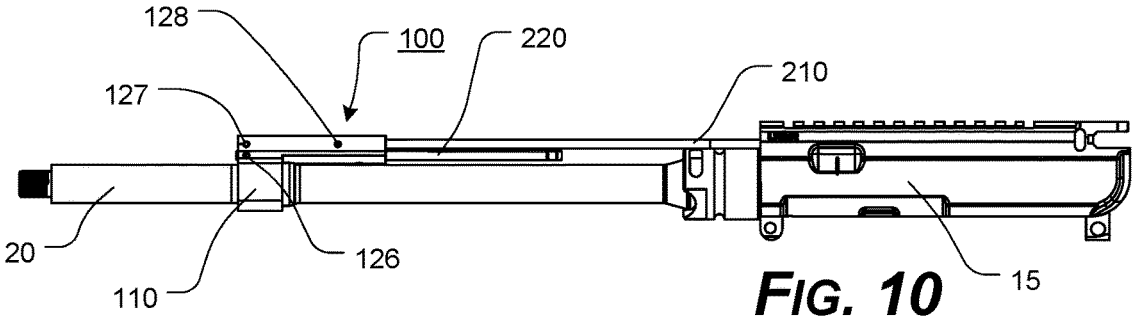
FIG. 10 illustrates a left side view of an exemplary embodiment of a gas block assembly attached or coupled to a firearm barrel and upper receiver, according to the presently disclosed systems, methods, and/or apparatuses.
Figure 11:
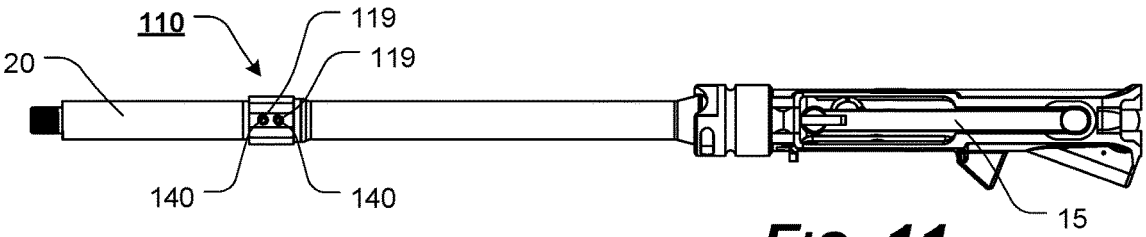
FIG. 11 illustrates a bottom view of an exemplary embodiment of a gas block assembly attached or coupled to a firearm barrel and upper receiver, according to the presently disclosed systems, methods, and/or apparatuses.
Figure 12:
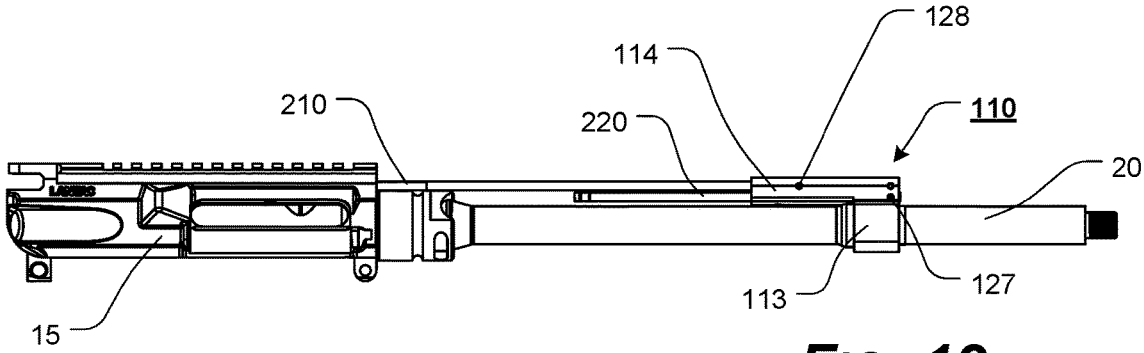
FIG. 12 illustrates a right side view of an exemplary embodiment of a gas block assembly attached or coupled to a firearm barrel and upper receiver, according to the presently disclosed systems, methods, and/or apparatuses.
Figure 13:
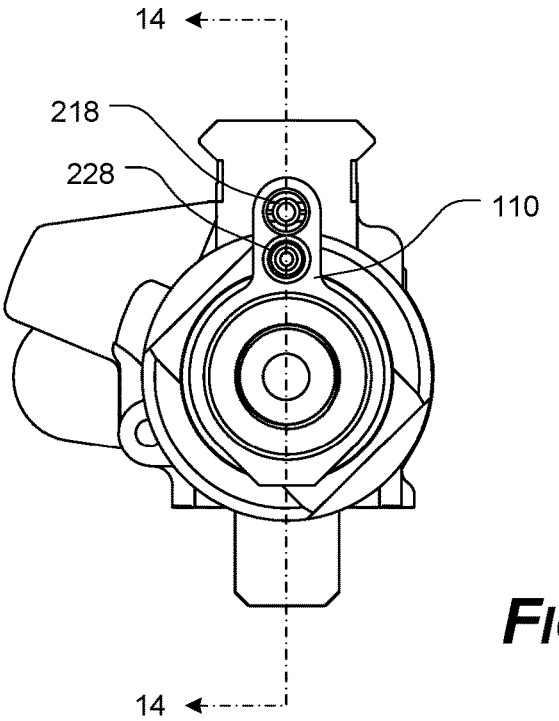
FIG. 13 illustrates a front view of an exemplary embodiment of a gas block assembly attached or coupled to a firearm barrel and upper receiver, according to the presently disclosed systems, methods, and/or apparatuses.
Figure 14:
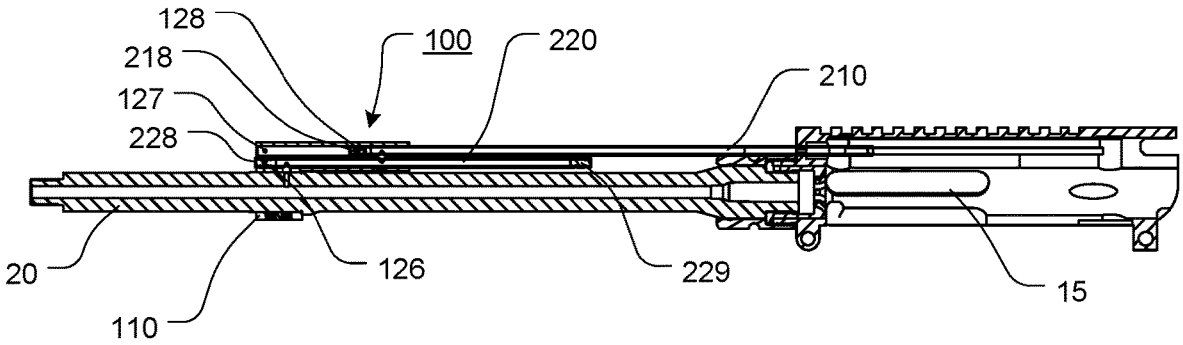
FIG. 14 illustrates a left side, cross-sectional view, taken along line 14-14 of FIG. 13, of an exemplary embodiment of a gas block assembly attached or coupled to a firearm barrel and upper receiver, according to the presently disclosed systems, methods, and/or apparatuses.
Figure 15:
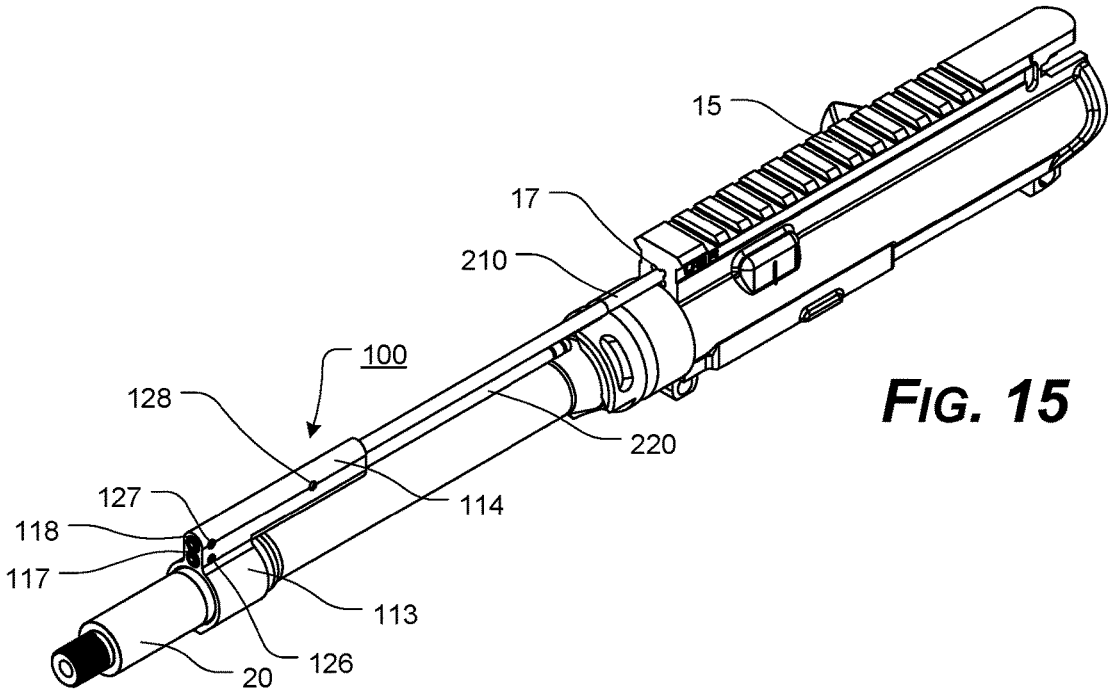
FIG. 15 illustrates a perspective view of an exemplary embodiment of a gas block assembly attached or coupled to a firearm barrel and upper receiver, according to the presently disclosed systems, methods, and/or apparatuses.
Figure 16:
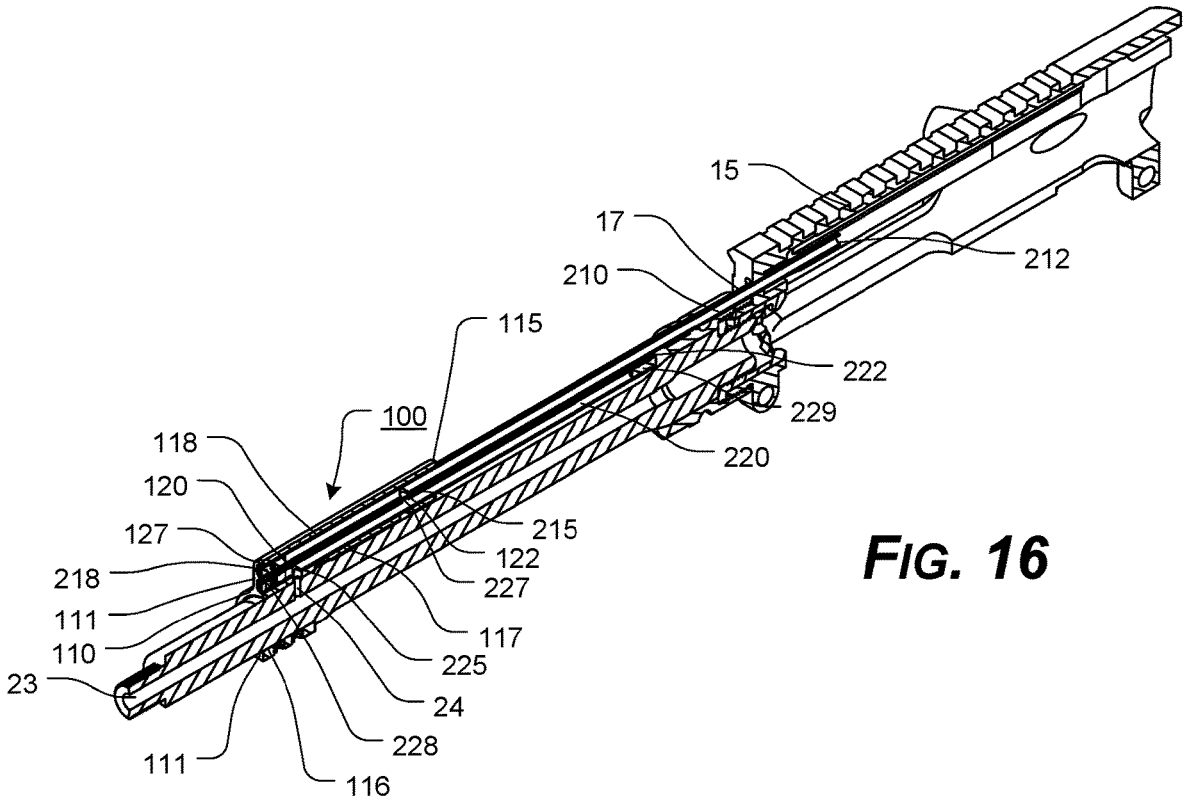
FIG. 16 illustrates a perspective, cross-sectional view of an exemplary embodiment of a gas block assembly attached or coupled to a firearm barrel and upper receiver, according to the presently disclosed systems, methods, and/or apparatuses.
Figure 17:
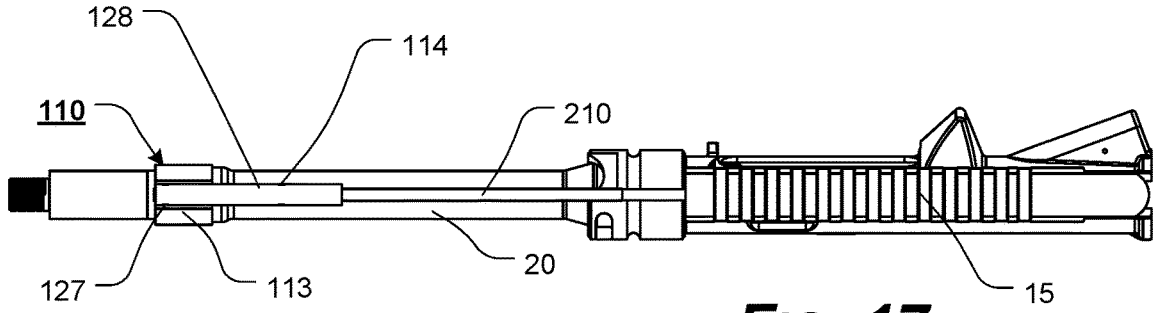
FIG. 17 illustrates a top view of an exemplary embodiment of a gas block assembly attached or coupled to a firearm barrel and upper receiver, according to the presently disclosed systems, methods, and/or apparatuses.
Figure 18:
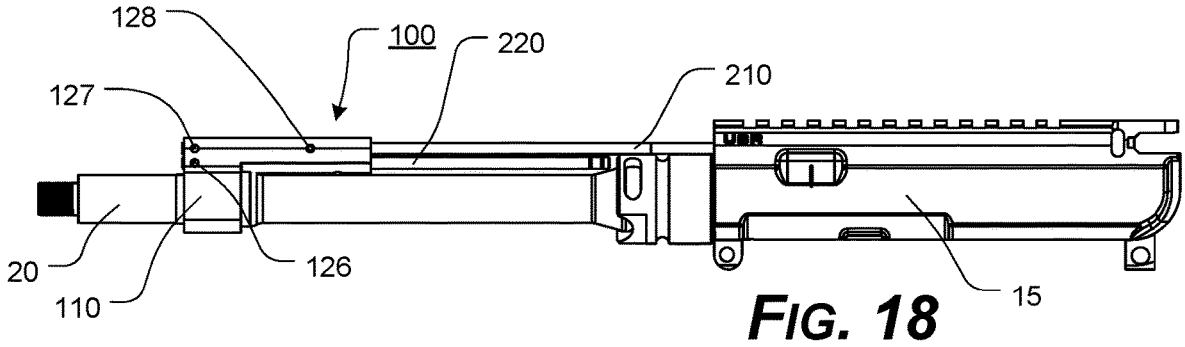
FIG. 18 illustrates a left side view of an exemplary embodiment of a gas block assembly attached or coupled to a firearm barrel and upper receiver, according to the presently disclosed systems, methods, and/or apparatuses.
Figure 19:
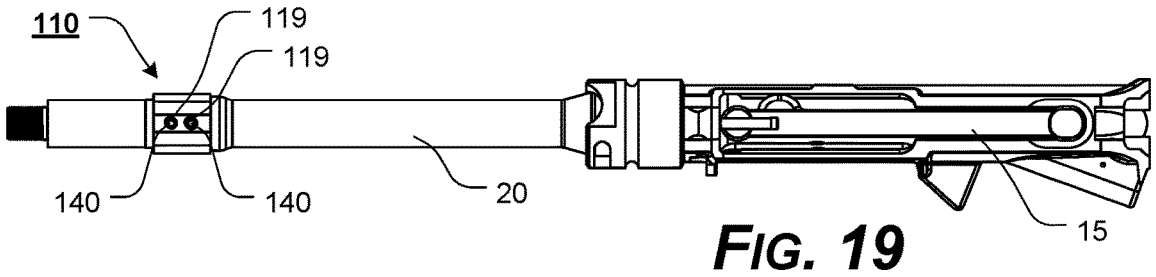
FIG. 19 illustrates a bottom view of an exemplary embodiment of a gas block assembly attached or coupled to a firearm barrel and upper receiver, according to the presently disclosed systems, methods, and/or apparatuses.
Figure 20:
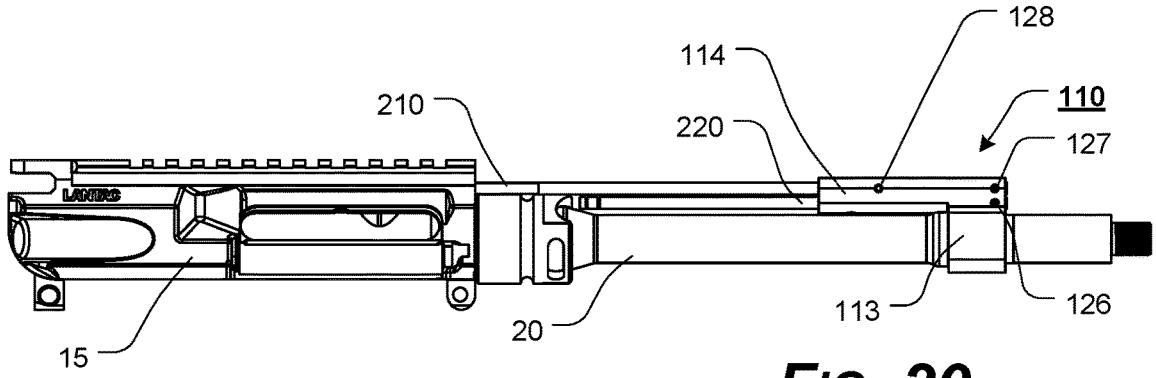
FIG. 20 illustrates a right side view of an exemplary embodiment of a gas block assembly attached or coupled to a firearm barrel and upper receiver, according to the presently disclosed systems, methods, and/or apparatuses.
Figure 21:
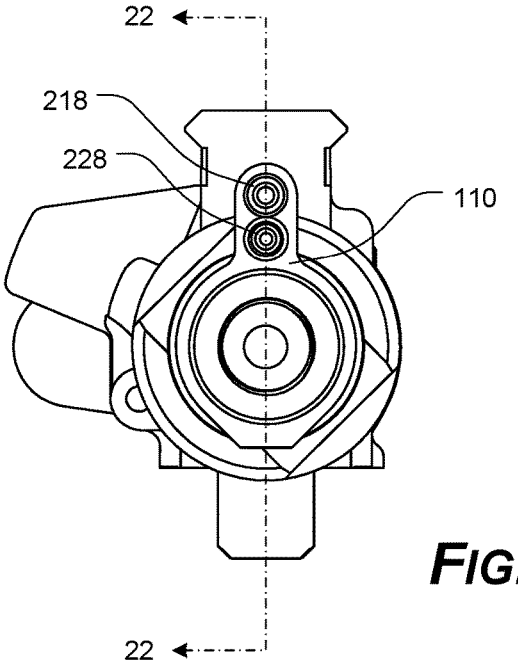
FIG. 21 illustrates a front view of an exemplary embodiment of a gas block assembly attached or coupled to a firearm barrel and upper receiver, according to the presently disclosed systems, methods, and/or apparatuses.
Figure 22:
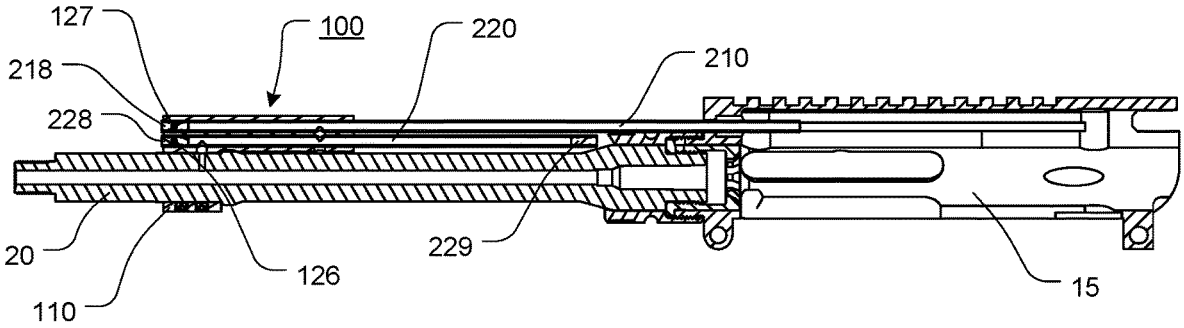
FIG. 22 illustrates a left side, cross-sectional view, taken along line 22-22 of FIG. 21, of an exemplary embodiment of a gas block assembly attached or coupled to a firearm barrel and upper receiver, according to the presently disclosed systems, methods, and/or apparatuses.

Turning now to the drawing Figs., FIGS. 1 and 2 illustrate certain elements and/or aspects of a known, exemplary AR-15 style barrel assembly 10, showing a known front sight (or gas block) 40.

Generally, the barrel assembly 10 includes a barrel 20 extending from an upper receiver 15. The barrel 20 includes a bore 23 and a barrel gas port 24. A front sight (or gas block) 40 is fitted to the barrel 20 such that a front sight gas port 45 is aligned with the barrel gas port 24 and a gas tube port 35, such that the bore 23 is in fluid communication (via barrel gas port 24, front sight gas port 45, and gas tube gas port 35) with the gas tube 30. In this manner, the barrel assembly 10 is able to operate, as described above.

It should be appreciated that a more detailed explanation of the components of the barrel assembly 10, instructions regarding how to attach and use the various components of the barrel assembly 10, methods for installing the related components of the barrel assembly 10, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the systems, methods, and/or apparatuses as described.

FIGS. 3-14 illustrate certain elements and/or aspects of an exemplary embodiment of a gas block assembly 100, wherein the gas block assembly 100 is utilized in connection with a 14½ inch barrel, according to this invention, while FIGS. 15-22 illustrate certain elements and/or aspects of an exemplary embodiment of a gas block assembly 100, wherein the gas block assembly 100 is utilized in connection with a 10½ inch barrel. In certain illustrative, non-limiting embodiments of this invention, as illustrated in FIGS. 3-22, the gas block assembly 100 comprises at least some of a gas block 110 having a gas block body portion 113 and a gas block extension portion 114, an initial gas tube 220, and a primary gas tube 210.

As illustrated, the gas block 110 extends, along a longitudinal axis $A_L$, from a distal end 111 to a proximal end 112 and includes the gas block body portion 113 and the gas block extension portion 114. A gas block barrel borehole 116 extends through the gas block body portion 113, along the longitudinal axis $A_L$. The gas block barrel borehole 116 is adapted to receive at least a portion of a barrel 20 therethrough. In various exemplary embodiments, the gas block barrel borehole 116 is adapted to receive a portion of a barrel 20 having an outer diameter of approximately 0.075 inches. Alternatively, the gas block barrel borehole 116 may be adapted to receive a portion of a barrel 20 having an outer diameter of approximately 0.080 inches. It should be appreciated that the gas block barrel borehole 116 may be adapted to receive a portion of a barrel 20 having any desired outer diameter.

The gas block extension portion 114 extends from the gas block body portion 113. The gas block extension portion 114 extends from an upper portion of the gas block body portion 113 and, in certain exemplary embodiments, at least a portion of the gas block extension portion 114 extends beyond at least a portion of the proximal end 112 of the gas block body portion 113. In various exemplary embodiments, the gas block extension portion 114 does not extend beyond the proximal end 112 of the gas block body portion 113.

The gas block initial borehole 117 and the gas block primary borehole 118 are formed through at least a portion of the gas block extension portion 114.

The gas block initial borehole 117 extends through the gas block extension portion 114, along the longitudinal axis, $A_L$, of the gas block extension portion 114, parallel to the gas block barrel borehole 116. The gas block initial borehole 117 extends from the distal end 111 of the gas block extension portion 114 to the proximal end 115 of the gas block extension portion 114. The gas block initial borehole 117 is adapted to receive at least a portion of the initial gas tube 220 therein.

In various exemplary, nonlimiting embodiments, the initial gas tube 220 includes an initial gas tube roll pin aperture 226 that can be aligned with a distal initial gas tube roll pin aperture 126 formed through at least a portion of the gas block extension portion 114. In this manner, the initial gas tube 220 may be attached or coupled within at least a portion of the gas block initial borehole 117, via interaction of a roll pin with the initial gas tube roll pin aperture 226 and the distal initial gas tube roll pin aperture 126.

The gas block primary borehole 118 extends through the gas block extension portion 114, along the longitudinal axis, $A_L$, of the gas block extension portion 114, parallel to the gas block barrel borehole 116. The gas block primary borehole 118 extends from the distal end 111 of the gas block extension portion 114 to the proximal end 115 of the gas block extension portion 114. The gas block primary borehole 118 is adapted to receive at least a portion of the primary gas tube 210 therein.

In various exemplary, nonlimiting embodiments, the primary gas tube 210 includes a primary gas tube roll pin aperture 217 that can be aligned with either a distal primary gas tube roll pin aperture 127 or a proximal primary gas tube roll pin aperture 128, each of which is formed through at least a portion of the gas block extension portion 114 at spaced apart locations. In this manner, the primary gas tube 210 may be attached or coupled within at least a portion of the gas block primary borehole 118, via interaction of a roll pin with the primary gas tube roll pin aperture 217 and either the distal primary gas tube roll pin aperture 127 or the proximal primary gas tube roll pin aperture 128. In this manner, the depth of the primary gas tube 210 within the gas block primary borehole 118 can be adjusted between at least two positions. It should be appreciated that additional primary gas tube roll pin apertures may be formed in the gas block extension portion 114, providing additional adjustment or tuning of the length of the portion of the primary gas tube 210 that extends from the gas block 110.

A gas block barrel gas port 120 is disposed between the gas block barrel borehole 116 and the gas block initial borehole 117 and a gas tube gas port 122 is disposed between the gas block initial borehole 117 and the gas block primary borehole 118.

The gas block barrel gas port 120 is disposed between the gas block barrel borehole 116 and the gas block initial borehole 117, such that the gas block barrel borehole 116 is in fluid communication with the gas block initial borehole 117, via the gas block barrel gas port 120. The gas block barrel gas port 120 is formed such that, when the gas block 110 is properly secured to a barrel 20, and the initial gas tube 220 is properly secured within at least a portion of the gas block initial borehole 117, the barrel gas port 24 is aligned with and in fluid communication with the gas block barrel gas port 120 such that the bore 23 is in fluid communication (via the barrel gas port 24, the gas block barrel gas port 120, and the first initial gas tube port 225) with the interior of the initial gas tube 220.

The gas tube gas port 122 is disposed between the gas block initial borehole 117 and the gas block primary borehole 118, such that the gas block initial borehole 117 is in fluid communication with the gas block primary borehole 118, via the gas tube gas port 122. The gas tube gas port 122 is formed such that, when the initial gas tube 220 is properly secured within at least a portion of the gas block initial borehole 117 and the primary gas tube 210 is properly secured within at least a portion of the gas block primary borehole 118, the primary gas tube port 215 and the second initial gas tube port 227 are each aligned with and in fluid communication with the gas tube gas port 122 such that the interior of the initial gas tube 220 is in fluid communication (via the gas tube gas port 122) with the interior of the primary gas tube 210.

Once appropriately positioned around the barrel 20, the gas block 110 may optionally be held in place by a frictional fit between the inner surface of the gas block gas block barrel borehole 116 and the outer surface of the barrel 20. Alternatively, the gas block 110 may optionally include one or more setscrew apertures 119 formed through the gas block body portion 113, perpendicular to the gas block barrel borehole 116. The inclusion of the one or more setscrew apertures 119 allows the gas block 110 to be further secured to the barrel 20 via one or more setscrews 140.

In various exemplary, nonlimiting embodiments, the gas block 110 may be pinned to the barrel 20, in a manner similar to how a known front sight 40 is pinned to the barrel 20.

In various exemplary, nonlimiting embodiments, the initial gas tube 220 comprises an elongate, substantially linear, tubular portion of material, extending from an initial gas tube distal end 221 to an initial gas tube proximal end 222, and having an interior cavity formed therethrough. A first initial gas tube port 225 and a second initial gas tube port 227 are formed, at spaced apart locations, through the initial gas tube 220, so as to allow fluid communication between the interior cavity of the initial gas tube 220 and the exterior of the initial gas tube 220. In certain exemplary embodiments, the first initial gas tube port 225 is formed in a portion opposite a portion where the second initial gas tube port 227 is formed. In various exemplary, nonlimiting embodiments, the initial gas tube 220 port is formed proximate the initial gas tube distal end 221 of the initial gas tube 220.

In various exemplary, nonlimiting embodiments, a distal initial gas tube plug 228 is disposed within at least a portion of the interior of the initial gas tube 220, proximate an initial gas tube distal end 221 of the initial gas tube 220, to keep pressurized gas from escaping through the initial gas tube distal end 221 of the initial gas tube 220. Alternatively, the initial gas tube 220 may be formed having a closed initial gas tube distal end 221. Similarly, a proximal initial gas tube plug 229 is disposed within at least a portion of the interior of the initial gas tube 220, proximate an initial gas tube proximal end 222 of the initial gas tube 220, to keep pressurized gas from escaping through the initial gas tube proximal end 222 of the initial gas tube 220. Alternatively, the initial gas tube 220 may be formed having a closed initial gas tube proximal end 222.

In various exemplary, nonlimiting embodiments, the primary gas tube 210 comprises an elongate, substantially linear, tubular portion of material, extending from a primary gas tube distal end 211 to a primary gas tube proximal end 212, and having an interior cavity formed therethrough. A primary gas tube port 215 is formed through the primary gas tube 210, so as to allow fluid communication between the interior cavity of the primary gas tube 210 and the exterior of the primary gas tube 210. In various exemplary, nonlimiting embodiments, the primary gas tube port 215 is formed proximate the primary gas tube distal end 211 of the primary gas tube 210.

In various exemplary, nonlimiting embodiments, a primary gas tube plug 218 is disposed within at least a portion of the interior of the primary gas tube 210, proximate a primary gas tube distal end 211 of the primary gas tube 210, to keep pressurized gas from escaping through the primary gas tube distal end 211 of the primary gas tube 210. Alternatively, the primary gas tube 210 may be formed having a closed primary gas tube distal end 211. The primary gas tube proximal end 212 of the primary gas tube 210 is adapted to be received within a gas tube receiving aperture 17 of an upper receiver 15.

The length of each of the primary gas tube 210 and the initial gas tube 220 is a design choice, based upon the desired overall volume or length of the cavity that is to be created by the interior of the initial gas tube 220 and the interior of the primary gas tube 210. Because the interior cavity of the initial gas tube 220 is in fluid communication with the interior cavity of the primary gas tube 210, as joined by the gas block 110, as expelling gases are forced toward the primary gas tube proximal end 212 of the primary gas tube 210, the expelling gases must first fill the interior cavity of the initial gas tube 220 and the interior cavity of the primary gas tube 210.

If it is desired that the overall length of the joined initial gas tube 220 and primary gas tube 210 is to mimic a known, 15 inch gas tube, a 10 inch primary gas tube 210 may be selected, while a 5 inch initial gas tube 220 is selected. Alternatively, and 10½ inch primary gas tube 210 may be utilized in conjunction with a 4½ inch initial gas tube 220. It should be understood that the length of the primary gas tube 210 and initial gas tube 220 are designed choices, based upon the desired overall length of the primary gas tube 210 and the initial gas tube 220 (and the combined interior cavities of the gas tubes) gas block assembly 100.

It should be appreciated that certain elements of the gas block assembly 100 may be formed as an integral unit (such as, for example, the gas block body portion 113 and the gas block extension portion 114). Alternatively, suitable materials can be used and sections or elements made independently and attached or coupled together, such as by adhesives, welding, screws, rivets, pins, or other fasteners, to form the various elements of the gas block assembly 100.

It should also be understood that the overall size and shape of the gas block assembly 100 and the various portions thereof is a design choice based upon the desired functionality and/or appearance of the gas block assembly 100.

During assembly and use, the initial gas tube 220 is at least partially received within at least a portion of the gas block 110 and the primary gas tube 210 is at least partially received within at least a portion of the gas block 110. The gas block 110 is attached or coupled to the barrel, such that an interior of the gas block barrel borehole 116 is in fluid communication with the initial gas tube 220 and the initial gas tube 220 is in fluid communication with the primary gas tube 210. The primary gas tube 210 is then positioned at least partially within the gas tube receiving aperture 17 of the upper receiver 15.

In various exemplary, nonlimiting embodiments, the gas block initial borehole 117 extends through at least a portion of the gas block extension portion 114. The gas block barrel gas port 120 is formed between the gas block barrel borehole 116 and the gas block initial borehole 117, such that the gas block barrel gas port 120 allows fluid communication between the gas block barrel borehole 116 and the gas block initial borehole 117. The initial gas tube 220 is at least partially received within at least a portion of the gas block initial borehole 117. The first initial gas tube port 225 is formed through the initial gas tube 220 and the second initial gas tube port 227 is formed through the initial gas tube 220. The first initial gas tube port 225 is aligned with the barrel gas port 24 so as to allow fluid communication between the gas block barrel borehole 116 and an interior of the initial gas tube 220. The gas block primary borehole 118 extends through at least a portion of the gas block extension portion 114. The gas tube gas port 122 is formed between the gas block initial borehole 117 and the gas block primary borehole 118, such that the gas tube gas port 122 allows fluid communication between the gas block initial borehole 117 and the gas block primary borehole 118. The second initial gas tube port 227 is aligned with the gas tube gas port 122 so as to allow fluid communication between the interior of the initial gas tube 220 and the gas block primary borehole 118. The primary gas tube 210 is at least partially received within at least a portion of the gas block primary borehole 118. The primary gas tube port 215, formed through the primary gas tube 210, is aligned with the gas tube gas port 122 so as to allow fluid communication between the interior of the initial gas tube 220 and an interior of the primary gas tube 210.

Thus, during the firing cycle, as propellant gases flow through the barrel gas port 24, the propellant gases enter into the gas block 110 and flow through the aligned gas block barrel gas port 120 and first initial gas tube port 225 to enter into the interior cavity of the initial gas tube 220. When the interior cavity of the initial gas tube 220 is appropriately pressurized, propellant gases flow through the aligned gas tube gas port 122 and primary gas tube port 215 to enter into the interior cavity of the primary gas tube 210. Propellant gases then flow through the interior cavity of the primary gas tube 210 and exit through the open primary gas tube proximal end 212 (and into the bolt carrier key of the firearm's bolt carrier). In this manner, the combination of the primary gas tube 210 and the initial gas tube 220 provide a more regulated flow of expelling gases to the upper receiver 15 of the firearm.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A gas block assembly, comprising:

a gas block body portion;

a gas block extension portion extending from said gas block body portion;

a barrel borehole extending through at least a portion of said body portion, wherein said barrel borehole is adapted to receive at least a portion of a barrel therethrough;

a gas block initial borehole extending through at least a portion of said gas block extension portion;

a gas block barrel gas port formed between said barrel borehole and said gas block initial borehole, such that said gas block barrel gas port allows fluid communication between said barrel borehole and said gas block initial borehole;

an initial gas tube, wherein said initial gas tube is at least partially received within at least a portion of said gas block initial borehole, wherein a first initial gas tube port is formed through said initial gas tube, wherein a second initial gas tube port is formed through said initial gas tube, wherein said first initial gas tube port is aligned with said barrel gas port so as to allow fluid communication between said barrel borehole and an interior of said initial gas tube;

a gas block primary borehole extending through at least a portion of said gas block extension portion;

a gas tube gas port formed between said gas block initial borehole and said gas block primary borehole, such that said gas tube gas port allows fluid communication between said gas block initial borehole and said gas block primary borehole, wherein said second initial gas tube port is aligned with said gas tube gas port so as to allow fluid communication between said interior of said initial gas tube and said gas block primary borehole; and a primary gas tube, wherein said primary gas tube is at least partially received within at least a portion of said gas block primary borehole, wherein a primary gas tube port is formed through said primary gas tube; wherein said primary gas tube port is aligned with said gas tube gas port so as to allow fluid communication between said interior of said initial gas tube and an interior of said primary gas tube.

2. The gas block assembly of claim 1, wherein said gas block extension portion extends beyond said proximal end of said gas block body portion.

3. The gas block assembly of claim 1, wherein said gas block extension portion does not extend beyond said proximal end of said gas block body portion.

4. The gas block assembly of claim 1, wherein said initial gas tube port is formed proximate a distal end of said initial gas tube.

5. The gas block assembly of claim 1, wherein a proximal end of said primary gas tube is adapted to be received within a gas tube receiving aperture of an upper receiver.

6. The gas block assembly of claim 1, wherein a gas tube plug is disposed within at least a portion of said interior of said initial gas tube, proximate a distal end of said initial gas tube.

7. The gas block assembly of claim 1, wherein a gas tube plug is disposed within at least a portion of said interior of said initial gas tube, proximate a proximal end of said initial gas tube.

8. The gas block assembly of claim 1, wherein a gas tube plug is disposed within at least a portion of said interior of said primary gas tube, proximate a distal end of said primary gas tube.

9. The gas block assembly of claim 1, wherein said initial gas tube is attached or coupled within at least a portion of said gas block initial borehole, via interaction of a roll pin and a distal initial gas tube roll pin aperture.

10. The gas block assembly of claim 1, wherein said primary gas tube is attached or coupled within at least a portion of said gas block primary borehole, via interaction of a roll pin and a distal primary gas tube roll pin aperture.

11. The gas block assembly of claim 1, wherein said primary gas tube is attached or coupled within at least a portion of said gas block primary borehole, via interaction of a roll pin and a proximal primary gas tube roll pin aperture.

12. A gas block assembly, comprising:

a gas block body portion having a barrel borehole extending through at least a portion of said body portion, wherein said barrel borehole is adapted to receive at least a portion of a barrel therethrough;

a gas block extension portion extending from said gas block body portion;

a gas block initial borehole extending through at least a portion of said gas block extension portion;

a gas block barrel gas port formed between said barrel borehole and said gas block initial borehole, wherein said gas block initial borehole is in fluid communication with said barrel borehole, via said gas block barrel gas port;

a gas block primary borehole extending through at least a portion of said gas block extension portion; and a gas tube gas port formed between said gas block initial borehole and said gas block primary borehole, wherein said gas block primary borehole is in fluid communication with said gas block initial borehole, via said gas tube gas port.

13. The gas block assembly of claim 12, wherein an initial gas tube is at least partially received within at least a portion of said gas block initial borehole, and wherein a primary gas tube is at least partially received within at least a portion of said gas block primary borehole.

14. The gas block assembly of claim 12, wherein at least a portion of said initial gas tube is alignable within at least a portion of said gas block initial borehole such that said initial gas tube is in fluid communication with said barrel borehole and said gas block primary borehole and wherein at least a portion of said primary gas tube is alignable within at least a portion of said gas block primary borehole such that said primary gas tube is in fluid communication with said gas block initial borehole.

15. The gas block assembly of claim 12, wherein a first initial gas tube port is formed through said initial gas tube and a second initial gas tube port is formed through said initial gas tube.

16. The gas block assembly of claim 12, wherein a primary gas tube port is formed through said primary gas tube.

17. The gas block assembly of claim 12, wherein said gas block barrel gas port is formed within a portion of said gas block body.

18. The gas block assembly of claim 12, wherein said gas tube gas port is formed within a portion of said gas block body.

19. The gas block assembly of claim 12, wherein said gas block extension portion extends beyond a proximal end of said gas block body portion.

20. A gas block assembly, comprising:

a gas block having a barrel borehole, wherein said barrel borehole is adapted to receive at least a portion of a barrel therethrough;

an initial gas tube at least partially received within at least a portion of a gas block initial borehole of said gas block; and a primary gas tube at least partially received within at least a portion of a gas block primary borehole said gas block, wherein said barrel borehole is in direct fluid communication with said gas block initial borehole via a gas block barrel gas port formed between said barrel borehole and said gas block initial borehole, wherein said gas block initial borehole is in direct fluid communication with said gas block primary borehole via a gas tube gas port formed between said gas block initial borehole and said gas block primary borehole, wherein an interior of said barrel borehole is in fluid communication with said initial gas tube via said gas block barrel gas port, and wherein said initial gas tube is in fluid communication with said primary gas tube via said gas tube gas port.

* * * * *